US011484167B2

(12) United States Patent
Kane et al.

(10) Patent No.: US 11,484,167 B2
(45) Date of Patent: Nov. 1, 2022

(54) APPARATUS FOR DISENTANGLEMENT OF FIBERS FROM ROTORS

(71) Applicant: INTERNATIONAL BUSINESS MACHINES CORPORATION, Armonk, NY (US)

(72) Inventors: Michael Kane, Poughkeepsie, NY (US); Jacob Porter, Highand, NY (US); Suraush Khambati, Poughkeepsie, NY (US); Colin Edward Masterson, Rochester, MN (US); Marie Cole, Wappingers Falls, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 222 days.

(21) Appl. No.: 15/931,021

(22) Filed: May 13, 2020

(65) Prior Publication Data

US 2021/0353119 A1 Nov. 18, 2021

(51) Int. Cl.
*A47L 9/04* (2006.01)
*A47L 11/19* (2006.01)

(52) U.S. Cl.
CPC ..... *A47L 9/0477* (2013.01); *A47L 11/19* (2013.01)

(58) Field of Classification Search
CPC ..... A47L 9/0477; A47L 9/0461; A47L 11/19; A47L 9/0613
See application file for complete search history.

(56) References Cited

U.S. PATENT DOCUMENTS 1,813,325 A * 7/1931 Smith ..... A47L 11/4077 15/48
2,032,345 A * 3/1936 Cranon ..... A47L 11/4041 15/48
4,979,838 A 12/1990 Yokota
6,539,575 B1 4/2003 Cohen
(Continued)

FOREIGN PATENT DOCUMENTS

EP 3440972 A1 2/2019

OTHER PUBLICATIONS

Liszewski, A., "Eureka's New Vac Automatically Cleans Disgusting Hair From Its Brushroll," Gizmodo, URL: https://gizmodo.com/eurekas-new-vac-automatically-cleans-disgusting-hair-fr-1699742433. Apr. 23, 2015. 4 pages.
(Continued)

*Primary Examiner* — Monica S Carter
*Assistant Examiner* — Sarah Akyaa Fordjour
(74) *Attorney, Agent, or Firm* — Cantor Colburn LLC; Tihon Poltavets

(57) ABSTRACT

A rotor assembly is provided and includes a rotor, tongs and an actuation system. The rotor includes a shaft defining a rotational axis about which the rotor is rotatable and rotor elements supported on the shaft to define grooves. The tongs are disposed in the grooves to occupy and move between first and second positions. At the first positions, the tongs are retracted from the grooves. At the second positions, the tongs are engaged in the grooves to disentangle fibers from the rotor. The actuation system is configured to bias the tongs toward the first positions and is actuatable to drive the tongs into the second positions.

20 Claims, 5 Drawing Sheets

(56) References Cited

U.S. PATENT DOCUMENTS

| | | | | |
|---|---|---|---|---|
| 6,892,420 | B1 | 5/2005 | Haan | |
| 8,601,643 | B2 | 12/2013 | Eriksson | |
| 9,314,140 | B2 * | 4/2016 | Eriksson | A47L 9/30 |
| 9,375,122 | B2 | 6/2016 | Eriksson | |
| 9,820,626 | B2 | 11/2017 | Eriksson | |
| 10,045,672 | B2 | 8/2018 | Eriksson | |
| 10,117,553 | B2 | 11/2018 | Eriksson | |
| 11,076,731 | B2 * | 8/2021 | Park | A47L 9/0477 |
| 2009/0151536 | A1 | 6/2009 | Arrington | |
| 2014/0053362 | A1 | 2/2014 | Hosterman | |
| 2014/0352104 | A1 | 12/2014 | Eriksson | |
| 2018/0184862 | A1 | 7/2018 | Choi | |
| 2018/0338654 | A1 * | 11/2018 | Kelsey | A47L 9/0477 |

OTHER PUBLICATIONS

Marketwire, "Goodbye Scissors: Electrolux(R) BrushRollClean Technology Gets Rid of Tangled Hair With the Push of a Button," Yahoo! News, URL: https://www.yahoo.com/news/goodbye-scissors-electrolux-r-brushrollclean-173500372.html. Sep. 27, 2012. 6 pages.

Electrolux Upright Vacuum Brushroll Clean EL8807A Product Description. Retrieved May 13, 2020 from Amazon.com; URL: https://www.amazon.com/Electrolux-Upright-Vacuum-Brushroll-Silver/dp/B009YQTDKE. 2 pages.

* cited by examiner

APPARATUS FOR DISENTANGLEMENT OF FIBERS FROM ROTORS

BACKGROUND

The present invention generally relates to rotors and, more specifically, to an apparatus for disentanglement of fibers from rotors.

A rotor is used in a vacuum cleaner or lawnmower. In the case of vacuum cleaners, as air is drawn into the vacuum cleaner, the air flows over a rotor while the rotor rotates. Brushes on the rotor agitate debris in carpeting or flooring so that the debris is enjoined into the airflow, which increases the efficiency of the cleaning effect.

SUMMARY

Embodiments of the present invention are directed to a rotor assembly. A non-limiting example of the rotor assembly includes a rotor, tongs and an actuation system. The rotor includes a shaft defining a rotational axis about which the rotor is rotatable and rotor elements supported on the shaft to define grooves. The tongs are disposed in the grooves to occupy and move between first and second positions. At the first positions, the tongs are retracted from the grooves. At the second positions, the tongs are engaged in the grooves to disentangle fibers from the rotor. The actuation system is configured to bias the tongs toward the first positions and is actuatable to drive the tongs into the second positions.

Embodiments of the present invention are directed to a rotor assembly. A non-limiting example of the rotor assembly includes a housing defining a pathway, a rotor, tongs and an actuation system. The rotor is rotatably disposed in the pathway and includes a shaft defining a rotational axis about which the rotor is rotatable and rotor elements supported on the shaft to define grooves. The tongs are disposed in the grooves to occupy and move between first and second positions. At the first positions, the tongs are retracted from the grooves. At the second positions, the tongs are engaged in the grooves to disentangle fibers from the rotor with the rotor continuing to rotate. The actuation system is configured to bias the tongs toward the first positions and is actuatable with the rotor continuing to rotate to drive the tongs into the second positions.

Embodiments of the present invention are directed to a method of operating a rotor assembly that includes tongs disposed to occupy and move between disengaged positions and engaged positions at which the tongs are engaged to disentangle fibers from a rotor. A non-limiting example of the method includes identifying that fibers are entangled in the rotor; actuating an actuation system configured to bias the tongs toward the disengaged positions such that the actuation system drives the tongs into the engaged positions and de-actuating the actuation system.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

The diagrams depicted herein are illustrative. There can be many variations to the diagrams or the operations described therein without departing from the spirit of the invention. For instance, the actions can be performed in a differing order or actions can be added, deleted or modified. Also, the term "coupled" and variations thereof describe having a communications path between two elements and do not imply a direct connection between the elements with no intervening elements/connections between them. All of these variations are considered a part of the specification.

DETAILED DESCRIPTION

One or more embodiments of the present invention provide a roller head that is designed to be easily cleaned without disassembly or additional tools. The roller head includes a rotor and a series of blades that are incorporated into the head on a spring-loaded arm designed to clear fibers upon vertical pressing by insertion into narrow channels on the roller. Features of the roller include conical elements with narrow cross-sectional channels at regular intervals along the length of the roller. The channels allow for insertions of the blades into the channels whereby the blades cut below the surface of the roller on which tangled fibers rest. The spring-loaded arm can be vertically oriented and includes a series of spring-loaded tongs to which the blades are coupled enabling close cuts without the risk of damage being caused to the roller head itself. In general, the roller head improves user safety by not requiring disassembly, lifting or application of external cutting tools to remove tangled fibers.

Rotor head cleaners have been a staple of households for decades. Nevertheless, there are design issues with these devices. For example, rotor heads with brushes, which are used for agitating debris in carpeting to improve cleaning efficiency, can easily become tangled with fibers like hair and pet fur. Cleaning of such rotor heads often requires disassembly and manual cutting of hair and fur fibers to free tangles from the rotor.

Solutions for the problem of entangled fibers involve the use of a blade. This blade is typically blunt lest it present a risk of cutting through bristles on surfaces of rollers of the rotor head. As such, the blade works on the basis of pinching and not cutting. That is, the blunt blade tends to pinch off entangled fibers to thereby loosen them from the rollers. The use of one or more blades is not usually paired with additional features, such as channels for cutting without causing damage to the roller, and normally only works when the rollers spin. This leads to high degrees of frictional wear and risk of moving parts causing damage.

As will be described below, a roller head is provided in accordance with one or more embodiments of the present invention to be easily cleaned without disassembly or additional tools and uses cutting blades that do not touch the bristles of the rollers.

Figure 1:
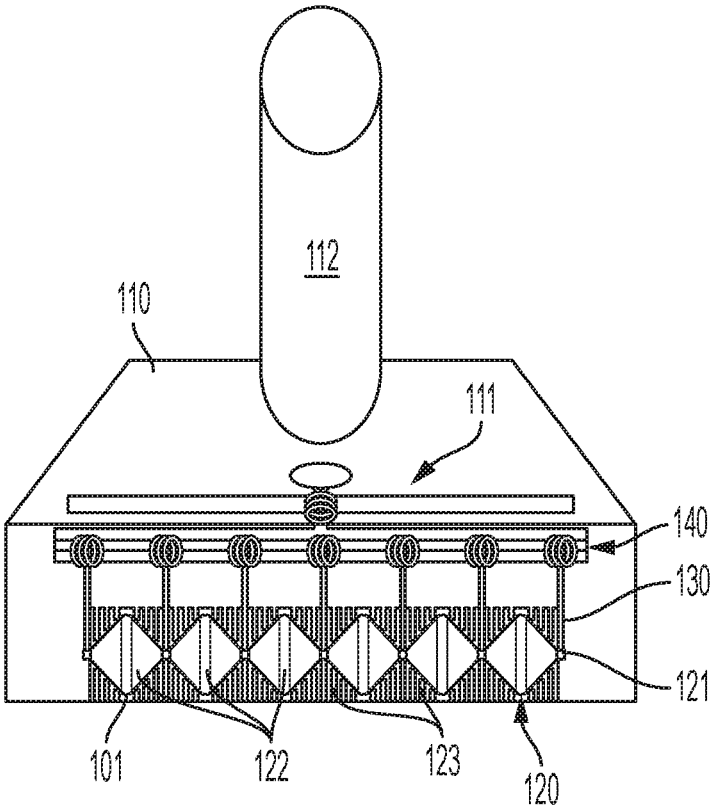
FIG. 1 is a front perspective view of a rotor assembly in a housing in accordance with one or more embodiments of the present invention.
Figure 2:
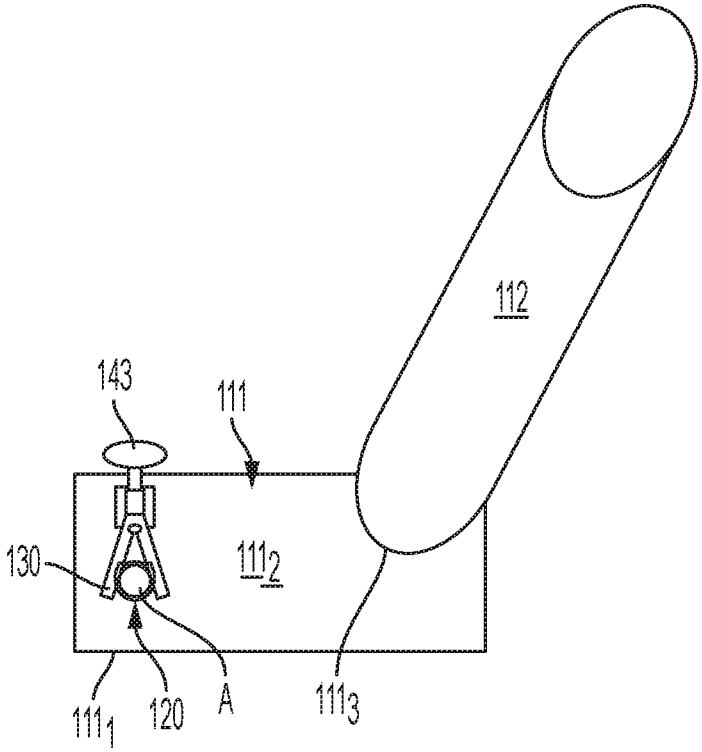
FIG. 2 is a side perspective view of a rotor assembly in a housing in accordance with one or more embodiments of the present invention.

Turning now to FIGS. 1 and 2, a rotor assembly 101 is provided and includes a housing 110 that is formed to define a pathway 111, a rotor 120 that is rotatably disposed in the pathway 111, tongs 130 and an actuation system 140. The rotor 120 includes a shaft 121 defining a rotational axis A (see FIG. 2) about which the rotor 120 is rotatable, rotor elements 122 that are supported on the shaft 121 and brushes 123 that are attached separately or in groups to each of the rotor elements 122. As the rotor 120 rotates about the rotational axis A, the rotor elements 122 and the brushes 123 rotate together. The housing 110 can include or be provided as at least one or more of a manual or robotic vacuum cleaner housing 112, a hay roller or baler machine housing and a land clearing machine housing (all of which have a similar general configuration for the purposes of this disclosure) that are usable in industrial and/or agricultural applications. That is, the housing 110 includes an inlet $\mathbf{111}_1$, a main section $\mathbf{111}_2$ in which the rotor 120 is disposed and an outlet $\mathbf{111}_3$ that can be coupled with a storage bag or unit (see FIG. 2). The rotor assembly 101 can further include a blower element or engine that generates an airflow through the pathway 111 such that the airflow impinges upon and flows around the rotor 120.

In the case of the housing 110 being provided as a manual or robotic vacuum cleaner housing 112, the rotor assembly 101 can be provided for use in cleaning carpeting or other types of flooring. In these or other cases, the airflow draws dirt particles and fibers into the housing 110 via the inlet $\mathbf{111}_1$, around the rotor 120 and through the main section $\mathbf{111}_2$ and out of the housing 110 via the outlet $\mathbf{111}_3$. In the meantime, the rotation of the rotor elements 122 and the brushes 123 agitates the dirt particles and fibers so that they move more efficiently. Ideally, the dirt particles and fibers will pass by the rotor 120 but it is to be understood that at least the fibers will occasionally become entangled with the rotor 120. The rotor assembly 101 is configured to address the cases in which at least the fibers become entangled with the rotor 120.

With reference to FIGS. 3-6, the rotor elements 122 are arranged and configured along the shaft 121 to define channels or grooves 124 between adjacent or neighboring rotor elements 122. The tongs 130 are disposed in the grooves 124 to occupy and move between first positions and second positions. At the first positions, the tongs 130 are retracted from the grooves 124. At the second positions, the tongs 130 are engaged in the grooves 124 to disentangle fibers from the rotor 120 with the rotor stationary or continuing to rotate about the rotational axis A. The actuation system 140 is configured to bias the tongs 130 toward the first positions and is actuatable with the rotor stationary or continuing to rotate to drive the tongs 130 into the second positions.

In accordance with one or more embodiments of the present invention, the rotor elements 122 can each have a similar size, shape, and configuration whereby the grooves 124 can each have a similar size, shape, and configuration and can be separated from one another by a substantially similar interval. In an exemplary case, the rotor elements 122 can each include conical sections 310 such that the grooves 124 have complementary V-shapes with flat-bottoms corresponding to the shaft 121 (i.e., flat-bottomed V-shaped grooves 124).

Figure 3:
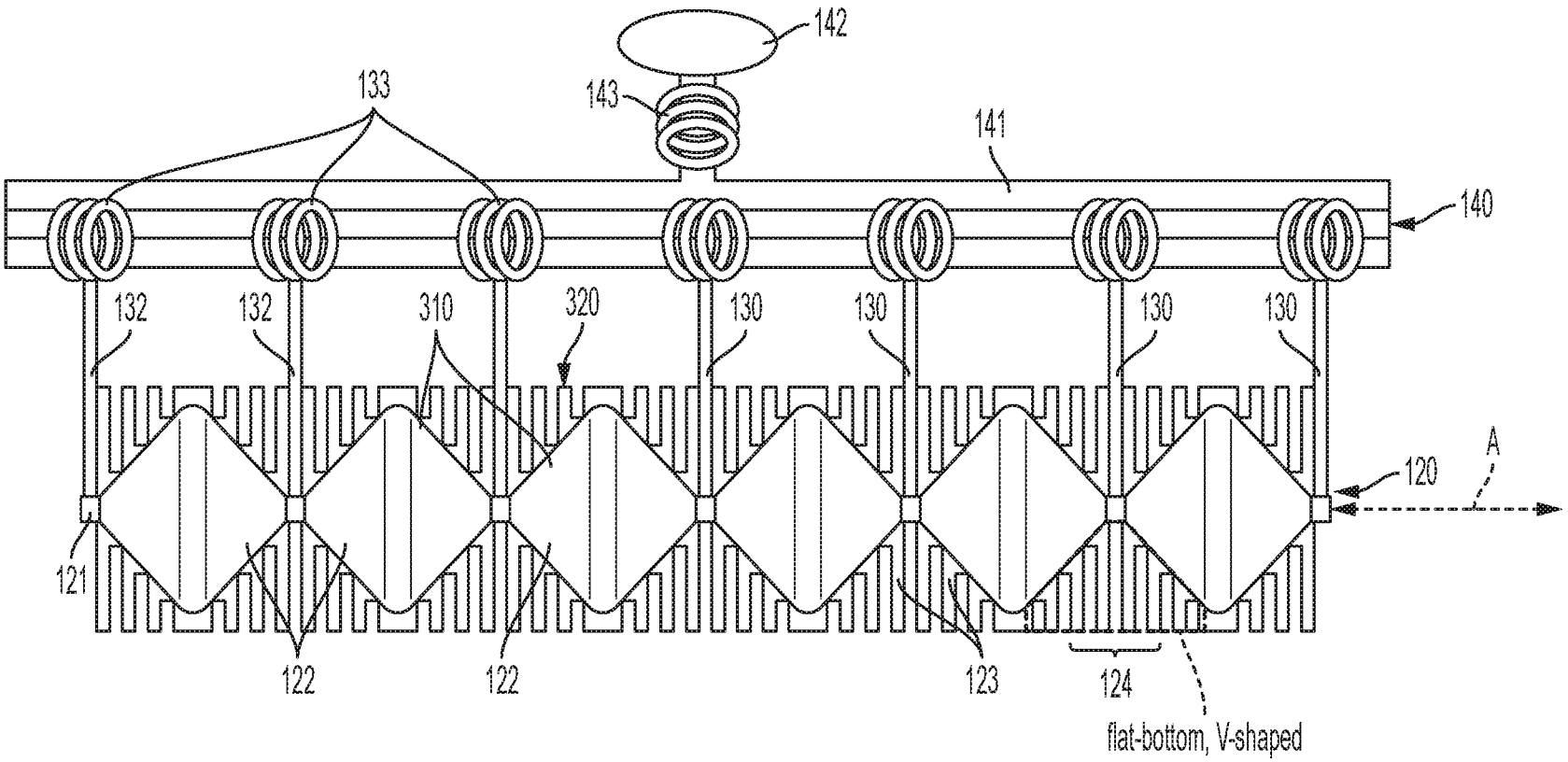
FIG. 3 is a schematic illustration of the rotor assembly of FIGS. 1 and 2 in accordance with one or more embodiments of the present invention.
Figure 4:
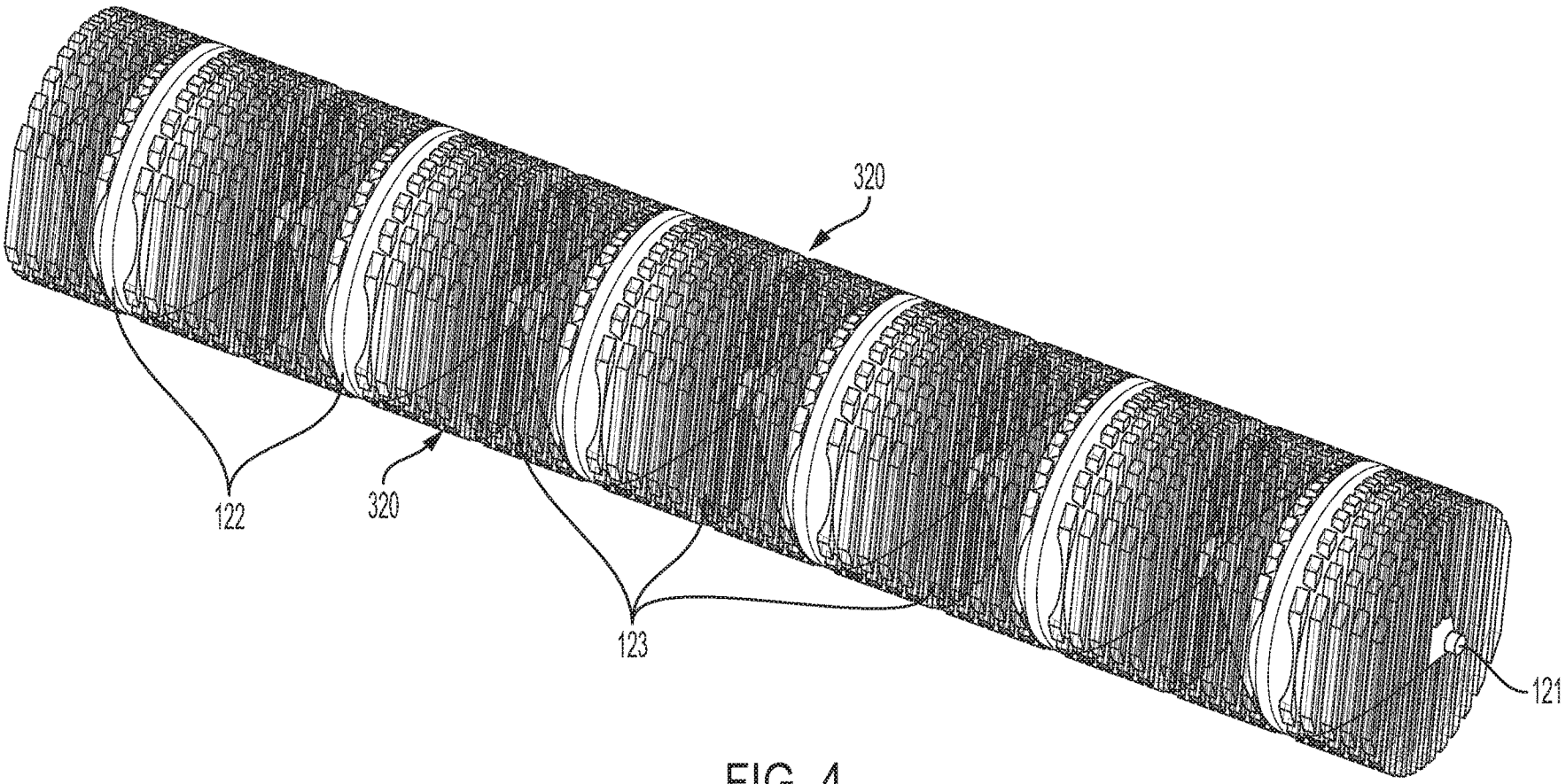
FIG. 4 is a perspective view of a rotor and brushes of the rotor assembly of FIG. 3 in accordance with one or more embodiments of the present invention.

As shown in FIGS. 3 and 4, where the rotor elements 122 can each include conical sections 310 that taper toward the shaft 121 in the grooves 124 such that the grooves 124 have complementary V-shapes with flat-bottoms corresponding to the shaft 121, the brushes 123 can be configured with varying lengths to accommodate the conical sections 310 whereby external edges of the brushes 123 form a substantially flat alignment 320. That is, the brushes 123 at the axial center of the rotor elements 122 are relatively short and the brushes 123 at or near the narrow ends of the conical sections 310 are relatively long.

Figure 5:
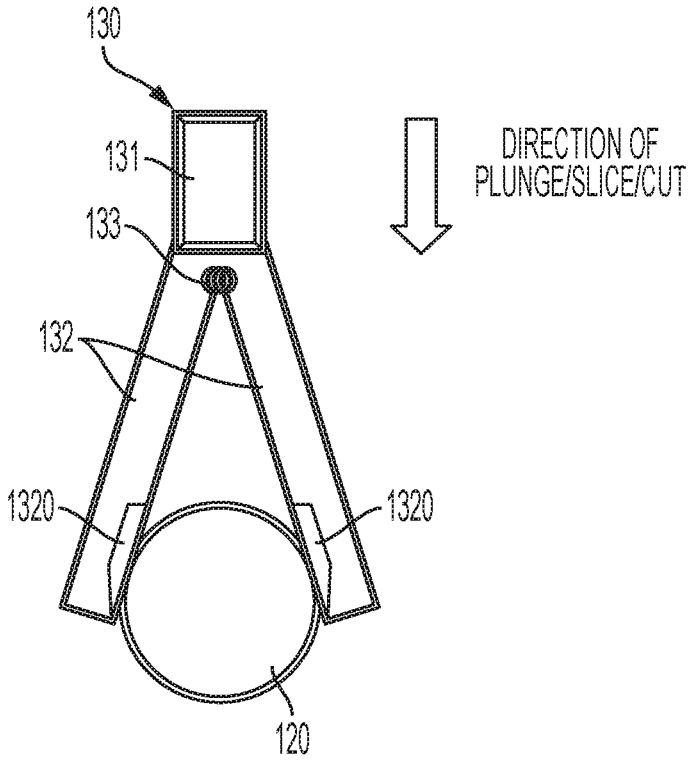
FIG. 5 is a side view of a rotor and tongs of the rotor assembly of FIG. 3 in accordance with one or more embodiments of the present invention.

As shown in FIG. 5, the tongs 130 each include a support shaft 131, upper and lower blades 132 and an elastic element 133. The upper and lower blades are pivotally attached to the support shaft 131 and are spring-loaded by the elastic element 133. The spring-loading of the upper and lower blades 132 is such that the upper and lower blades 132 automatically close toward each other with the tongs 130 occupying the first positions and, conversely, such that the upper and lower blades 132 automatically open with the tongs 130 occupying the second positions.

Although not shown, the tongs 130 can further include hinges by which the upper and lower blades 132 are pivotally attached to the support shaft 131.

With the automatic closure and the automatic opening of the upper and lower blades 132 being controlled in accordance of the tongs 130 occupying the first positions or the second positions, the upper and lower blades 132 can move toward and around components of the rotor 120 in the grooves 124 without actually touching the rotor 120. Thus, to the extent that the upper and lower blades 132 can be used to disentangle fibers from the rotor 120, the upper and lower blades 132 can do so without touching the rotor 120 and therefore without potentially impacting and damaging the rotor 120.

Each of the upper and lower blades 132 can, but is not required to, include a cutting element 1320. When provided, the cutting element 1320 can be disposable within the corresponding groove 124 and proximate to the rotor 120 whereby the cutting element 1320 can cut through fibers that might be entangled on the rotor 120.

Figure 6:
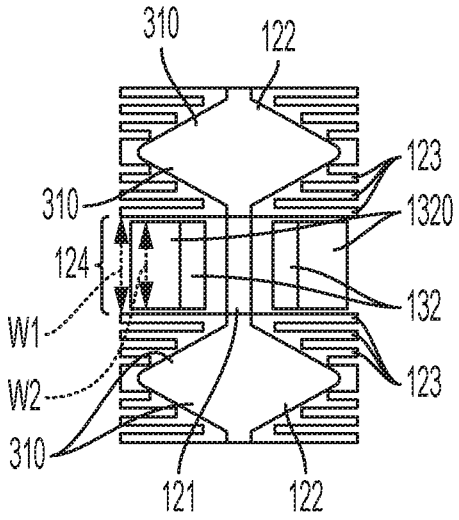
FIG. 6 is a front view of a rotor, tong blades, and brushes of the rotor assembly of FIG. 3 in accordance with one or more embodiments of the present invention.

As shown in FIG. 6, conical sections 310 of adjacent or neighboring rotor elements 122 are illustrated with an intervening section of the shaft 121 to define groove 124 having width W1. Here, the upper and lower blades 132 of the tong 130 have a width W2, which is only slightly smaller than the width W1. In this way, the effectiveness of the tongs 130 (see FIG. 5) can be maximized within the groove 124. In fact, respective widths W2 of the upper and lower blades 132 of each of the tongs 130 are a substantial fraction of respective widths W1 of corresponding ones of each of the grooves 124.

With reference back to FIGS. 2 and 3, the actuation system 140 includes a chassis 141, a button 142 coupled to the chassis 141 and an elastic element 143. The chassis 141 can be provided as an elongate member with which each of the tongs 130 are coupled. The button 142 is disposed at a distal end of a boss extending from the chassis 141 and can be supportively disposed at an exterior of the housing 110 (see FIG. 2) so that the button 142 is accessible to an operator or user. The elastic element 143 can be anchored between the button 142 and the housing 110 and is spring-loaded to bias the chassis 141 away from the rotor 120 and to thus bias the tongs 130 toward the first positions.

During operation of the rotor assembly 101, when an operator or user becomes aware that fibers are entangled with the rotor 120, the operator or user can actuate the actuation system 140 by pressing the button 142 against the bias of the elastic element 143 toward the housing 110 to thereby drive the chassis 141 toward the rotor 120 and to thereby drive the tongs 130 toward the second positions. Subsequently, the operator or user can de-actuate the actuation system 140 by releasing the button 142 whereby the bias of the elastic element 143 drives the chassis 141 away from the rotor 120 and the tongs 130 toward the first positions. In accordance with one or more embodiments of the present invention, the actuation and de-actuation of the actuation system 140 can be repeated by the operator or user by repeated pressing and releasing of the button 142 until the entangled fibers are disentangled from the rotor 120.

Although the button 142 is described herein as an analog feature, it is to be understood that this is not required and that other embodiments are possible. For example, the button 142 and the actuation system 140 can be actuated and controlled electronically with or without the involvement of the operator or user. For example, in a case where the button 142 is coupled with an electronic system including, for example a solenoid or another similar device, a pressing and releasing of the button 142 can cause the electronic system to activate and deactivate to drive the chassis 141 toward and away from the rotor 120. In a case where the actuation system 140 can be operable without the operator or user, the actuation system 140 can further include a sensor and processor to sense an entangled condition and to activate the actuation system 140 accordingly.

Although the tongs 130 and the actuation system 140 are described herein such that each of the tongs 130 are driven toward the first or second positions as a unit, it is to be understood that this is not required and that other embodiments are possible. For example, each tong 130 can be dependently or independently operable by the actuation system 140. In these or other cases, the operator or user (in the case of the actuation system 140 being non-automatically controlled) or the actuation system 140 itself (in the case of the actuation system 140 being automatic) can operate only those tongs 130 that are closest to an entanglement. That is, if fibers are entangled on the rotor in only one of the grooves 124, the tong 130 corresponding to that groove 124 can be driven between the first and second positions independently of the other tongs 130.

In accordance with one or more embodiments of the present invention, the actuation system 140 can be actuated and de-actuated with the rotor 120 continually rotating or with the rotor 120 stationary. As such, an entangled condition can be addressed prior to, during and/or after an operation of the rotor assembly 101.

Figure 7:
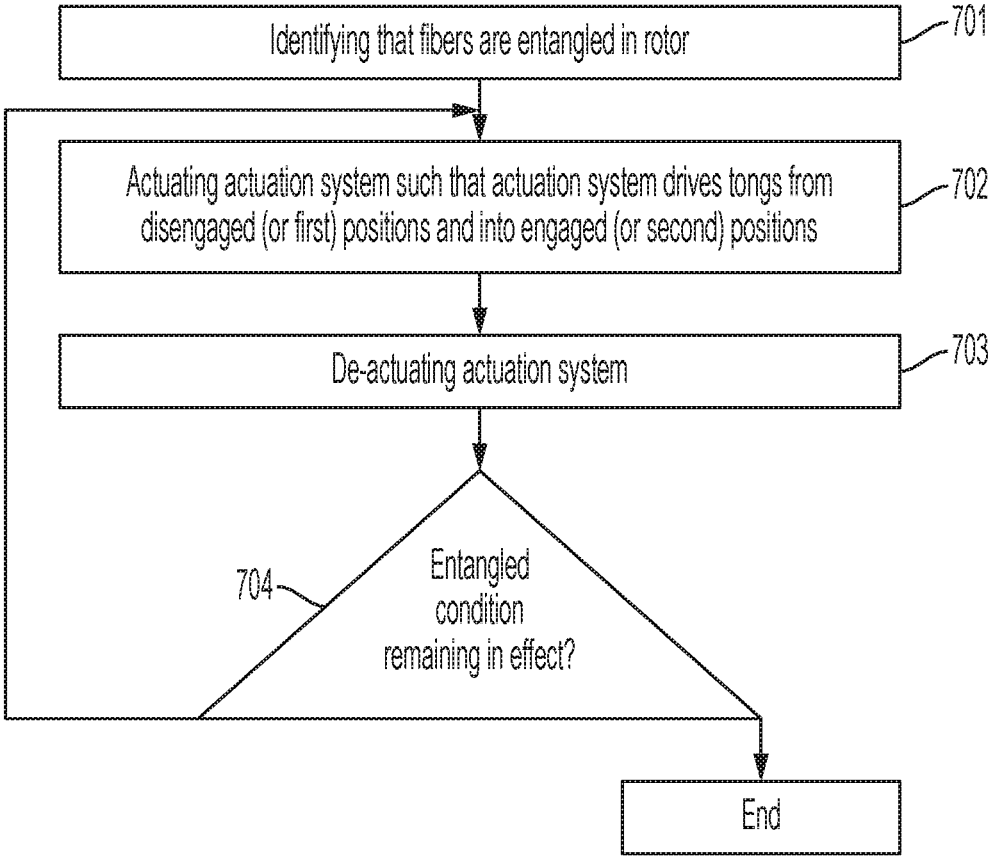
FIG. 7 is a flow diagram illustrating a method of operating a rotor assembly in accordance with one or more embodiments of the present invention.

With reference to FIG. 7, a method of operating a rotor assembly, such as the rotor assembly 101 described herein, is provided. As shown in FIG. 7, the method includes identifying that fibers are entangled in the rotor 120 (701), manually or automatically actuating the actuation system 140 such that the actuation system 140 drives the tongs 130 from disengaged (or the first) positions and into engaged (or the second) positions (702) and manually or automatically de-actuating the actuation system 140 (703). The method can further include determining whether the entangled condition remains in effect following the manual or automatic de-actuating of operation 703 (704) and either repeating the manual or automatic actuating and the manual or automatic de-actuating of operations 702 and 703 in an event the entangled condition remains in effect until fiber disentanglement can be confirmed or ending the method in an event the fiber disentanglement is confirmed. The rotor assembly (i.e., the rotor assembly 101) is activatable and/or continually activatable during execution of the method.

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

One or more of the methods described herein can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

In some embodiments, various functions or acts can take place at a given location and/or in connection with the operation of one or more apparatuses or systems. In some embodiments, a portion of a given function or act can be performed at a first device or location, and the remainder of the function or act can be performed at one or more additional devices or locations.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The present disclosure has been presented for purposes of illustration and description but is not intended to be exhaustive or limited to the form disclosed. Many modifications and variations will be apparent to those of ordinary skill in the art without departing from the scope and spirit of the disclosure. The embodiments were chosen and described in order to best explain the principles of the disclosure and the practical application and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the actions can be performed in a differing order or actions can be added, deleted or modified. Also, the term "coupled" describes having a signal path between two elements and does not imply a direct connection between the elements with no intervening elements/connections therebetween. All of these variations are considered a part of the present disclosure.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A rotor assembly, comprising:

a rotor comprising a shaft defining a rotational axis about which the rotor is rotatable and rotor elements supported along the rotational axis shaft to define grooves between neighboring rotor elements;

tongs arranged along the rotational axis of the shaft and respectively disposed in corresponding ones of the grooves to occupy and move between first positions at which the tongs are respectively retracted from the corresponding ones of the grooves and second positions at which the tongs are respectively engaged in the corresponding ones of the grooves to disentangle fibers from the rotor; and an actuation system configured to bias the tongs toward the first positions and actuatable to drive the tongs into the second positions.

2. The rotor assembly according to claim 1, wherein the rotor elements each comprise conical sections.

3. The rotor assembly according to claim 1, where the rotor further comprises brushes attached to each of the rotor elements.

4. The rotor assembly according to claim 1, wherein the grooves have flat-bottomed V-shapes.

5. The rotor assembly according to claim 1, wherein respective widths of each of the tongs are a substantial fraction of respective widths of corresponding ones of each of the grooves.

6. The rotor assembly according to claim 1, wherein:

the tongs each comprise upper and lower blades spring-loaded to close with the tongs occupying the first positions and to open with the tongs occupying the second positions, and the upper and lower blades being pivotally attached to a support shaft with the upper blades being spring-loaded to contact a first side of the rotor and the lower blades being spring-loaded to contact a second side of the rotor, which is opposite the first side.

7. The rotor assembly according to claim 1, wherein the actuation system is spring-loaded to bias the tongs toward the first positions and comprises:

a chassis having an elongate member with which each of the tongs are coupled;

a button disposed on a boss extending from the chassis and configured to be pushed to actuate the actuation system; and an elastic element anchored between the button and a housing to bias the chassis away from the rotor.

8. The rotor assembly according to claim 1, wherein the actuation system comprises a button configured to be pushed to actuate the actuation system.

9. A rotor assembly, comprising:

a housing defining a pathway;

a rotor rotatably disposed in the pathway and comprising a shaft defining a rotational axis about which the rotor is rotatable and rotor elements supported on the shaft to define grooves;

tongs disposed in the grooves to occupy and move between first positions at which the tongs are retracted from the grooves and second positions at which the tongs are engaged in the grooves to disentangle fibers from the rotor with the rotor continuing to rotate; and an actuation system configured to bias the tongs toward the first positions and actuatable with the rotor continuing to rotate to drive the tongs into the second positions.

10. The rotor assembly according to claim 9, wherein the housing comprises at least one or more of a manual or robotic vacuum cleaner housing, a hay roller or baler machine housing and a land clearing machine housing.

11. The rotor assembly according to claim 9, wherein the rotor elements each comprise conical sections.

12. The rotor assembly according to claim 9, where the rotor further comprises brushes attached to each of the rotor elements.

13. The rotor assembly according to claim 9, wherein the grooves have flat-bottomed V-shapes.

14. The rotor assembly according to claim 9, wherein respective widths of each of the tongs are a substantial fraction of respective widths of corresponding ones of each of the grooves.

15. The rotor assembly according to claim 9, wherein the tongs each comprise upper and lower blades spring-loaded to close with the tongs occupying the first positions and to open with the tongs occupying the second positions.

16. The rotor assembly according to claim 9, wherein the actuation system is spring-loaded to bias the tongs toward the first positions.

17. The rotor assembly according to claim 9, wherein the actuation system comprises a button supported at an exterior of the housing, the button being configured to be pushed to actuate the actuation system.

18. A method of operating a rotor assembly comprising tongs disposed to occupy and move between disengaged positions and engaged positions at which the tongs are engaged to disentangle fibers from a rotor, the method comprising:

identifying that fibers are entangled in the rotor;

actuating an actuation system configured to bias the tongs toward the disengaged positions such that the actuation system drives the tongs into the engaged positions; and de-actuating the actuation system.

19. The method according to claim 18, further comprising repeating the actuating and the de-actuating until fiber disentanglement is confirmed.

20. The method according to claim 18, wherein the rotor assembly is activatable and continually activatable during the identifying, the actuating and the de-actuating.

* * * * *